United States Patent [19]

Strickland

[11] 4,219,180

[45] Aug. 26, 1980

[54] TYING APPARATUS FOR CONCRETE FORM PANEL

[75] Inventor: James K. Strickland, Jacksonville, Fla.

[73] Assignee: Strickland Systems, Inc., Jacksonville, Fla.

[21] Appl. No.: 883,276

[22] Filed: Mar. 3, 1978

[51] Int. Cl.[2] ..... E04G 7/18

[52] U.S. Cl. ..... 249/219 R; 249/219 W

[58] Field of Search ..... 249/216, 219 R, 219 W

[56] References Cited

U.S. PATENT DOCUMENTS

| | | | |
|---|---|---|---|
| 3,018,538 | 1/1962 | Gates | 249/219 W |
| 3,984,079 | 10/1976 | Gates | 249/219 R |
| 4,044,986 | 8/1977 | Strickland | 249/216 |

FOREIGN PATENT DOCUMENTS

| | | | |
|---|---|---|---|
| 713619 | 10/1931 | France | 249/219 |

*Primary Examiner*—John A. Parrish

*Attorney, Agent, or Firm*—Schuyler, Birch, McKie & Beckett

[57] ABSTRACT

Tying apparatus for holding concrete form panels in spaced relation has an elongated tie and clamping means attachable to a concrete form panel which is engageable with the tie to anchor the tie so as to restrain relative movement between the tie and the form panel wherein the clamping means comprises a bearing member fixedly connectible to the form panel and a clamping member pivotally secured in its preferred form to the bearing member by means of an axially and laterally yieldable pivot connection so that the clamping member can pivot and swing relative to the plane of the bearing member by way of a ball and socket type joint on mating surfaces of the bearing and clamping members to compensate for misalignment between the tie and the form panel or misalignment between opposing form panels. A positive lock retains the bearing and clamping members together when the clamping member is in its closed position.

15 Claims, 3 Drawing Figures

TYING APPARATUS FOR CONCRETE FORM PANEL

BACKGROUND OF THE INVENTION

Concrete construction and more particularly the field of concrete construction form work and the apparatus employed for assembling such form work into functional units is the field of the subject invention. Specifically, this invention relates to anchoring apparatus for tying form work panels together by means of elongated ties. Particularly, the invention relates to the fastening devices or anchoring apparatus attachable to the ties to retain the panels against relative movement while the concrete is poured and setting up.

In the construction of concrete forms from panels maintained in spaced opposed relationship the prior art devices have proposed and utilized various constructions with differing degrees of success. Such devices have generally comprised a rod extending between and through both such panels with varying forms of wedging or locking devices provided to grip the ends of the tie and thus prevent outward movement of the form panels. Devices of this nature generally employ in conjunction with the forms, spacers to prevent inward movement of the forms. The rod end fastening devices are attached to walers on the form panels. The rod end fastening devices generally have taken the form of loops through which hooks are inserted, nuts treaded onto the end of a treaded tie, or a hot-upset "button" end similar to the head of a nail or bolt. One significant disadvantage that all such apparatus have suffered from, has been the difficulty of removal of the fastening device after the concrete structure has been poured and set. Expansion of the concrete during such setting greatly increases the outwardly exerted pressure against the form panels and thus against the tie rod and fastening devices to create this problem. Accordingly, it has required great force to release these prior art devices in order to remove the form panels. In removing the fastening devices the difficulty has resided principally in the inability of such devices to release the longitudinal stresses on the rod quickly upon the initiation of the releasing action. Another disadvantage suffered by structures using threaded ties and nuts or ties with enlarged headed ends, has been their inability to compensate for misalignment between the tie and the clamping structure on the form panel. Generally, this misalignment in prior art devices has been manifested by angular displacement of the tie from a line normal to the form panel. This misalignment has generally resulted in the imposition of longitudinal stress upon one corner or a very small portion of the tie end anchoring structure. Such a condition both increases the difficulty in releasing the clamp but also imposes severe bending stresses on the tie, leading to the potential for failure of the tie.

Considering the above mentioned disadvantages of the prior art devices an object of the present invention is to provide a concrete form tying apparatus in the form of an anchoring or clamping apparatus which may be quickly and easily installed to clamp form panels into place and may quickly and easily be removed to release such panels even when such panels are under great pressure from the concrete structure formed therein.

It is another object of this invention to provide a concrete form panel tying apparatus and specifically the anchoring apparatus for such a tie which simply and effectively compensates for some amount of misalignment between the tie and form panel, avoiding the imposition of excessive loading or bending of the form holding tie.

SUMMARY OF THE INVENTION

This invention, in brief, involves anchoring apparatus releasably clampingly engageable with a portion of an elongated tie which is extended outwardly through a concrete form panel. This anchoring apparatus is attachable to a concrete wall form panel for clamping the tie to restrain relative movement between the tie and the form panel. The clamping means comprises a member moveable between a clamping position receiving the portion of the tie extending outside the form panel referred to as a closed position and a non-clamping or open position disposed away from the tie. This clamping member has a recess or pocket for receiving the longitudinally inward extending tie portion. The clamping member to engage with the outwardly extending portion of the tie is pivotally connected to a load bearing member which is fixedly connectible to the outside of the form panel and has an opening through which a tie may extend. The connection between the load bearing and clamping members is preferably provided to enable both axial and lateral yieldable movement of the clamping member relative to the load bearing member to permit this clamping member to swing relative to the plane of the bearing member as well as to pivot relative to the bearing member. Aside from other specific features of the invention, a positive lock retains the bearing and clamping members together when the clamping member is in its closed position relative to the bearing member that is fixedly mounted on the form panel.

BRIEF DESCRIPTION OF THE DRAWINGS

The foregoing objects, as well as other, together with the advantages of the invention will become apparent through consideration of the following detailed description and the accompaning drawing illustrations in which.

DETAILED DESCRIPTION OF ILLUSTRATIVE EMBODIMENTS

Initially, it should be pointed out that the instant invention, as described in more detail hereinafter and as claimed herein, involves an improvement over the prior invention which is the subject of Strickland et al U.S. Pat. No. 4,044,986, issued Aug. 30, 1977. Extensive illustration of the tying apparatus used with concrete form panels as disclosed in this prior patent is not deemed to be necessary by way of re-illustration and description in this application. Accordingly, reference is made to this previously issued patent and its content is considered to be included by reference without the necessity of either again illustrating or describing the various basic features and details disclosed in such prior patent.

Figure 1:
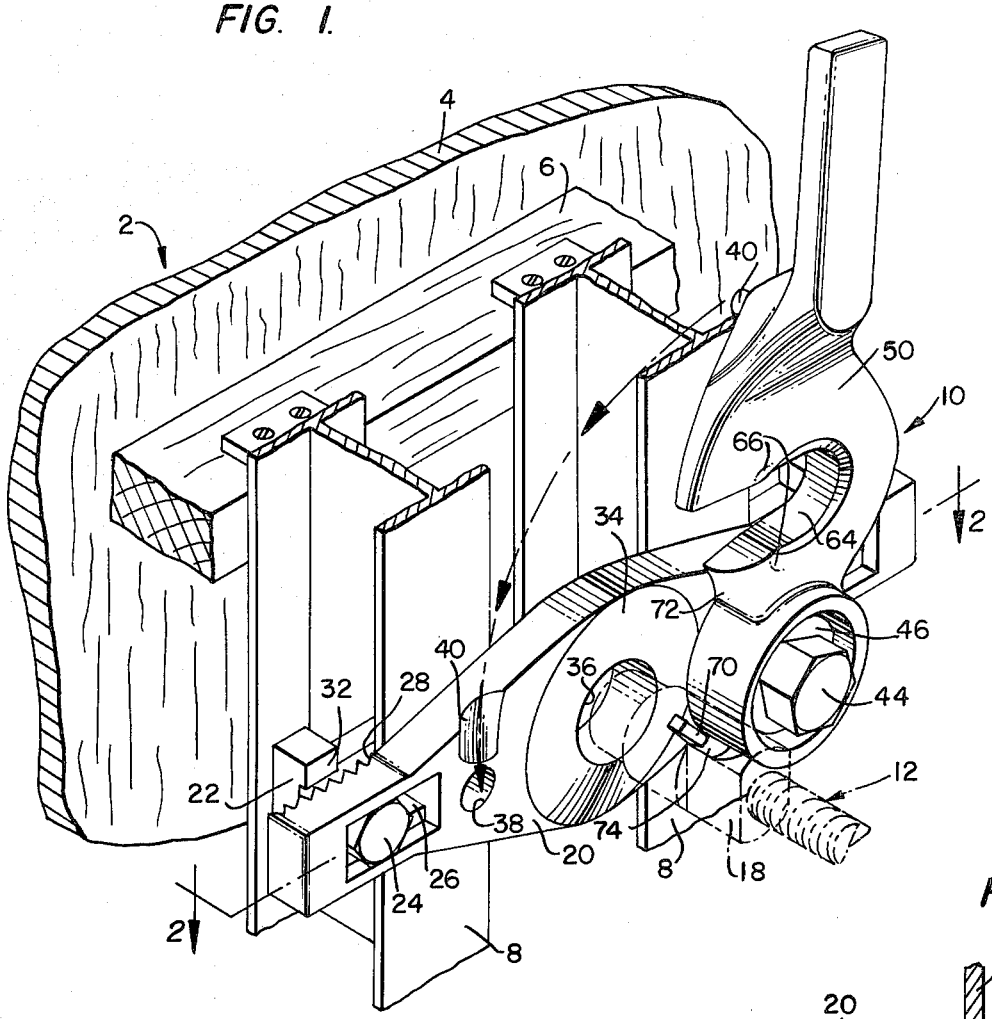
FIG. 1 illustrates in perspective a typical installation of the anchoring apparatus of the invention used in an installation of a concrete form panel tying environment.

To exemplify the anchoring apparatus of applicant's instant invention, the unit is illustrated in FIG. 1 in its environment of use and application. As disclosed in the prior U.S. Pat. No. 4,044,986, the environmental usage for the anchoring apparatus involves a concrete form panel 2. It of course will be understood that a pair of form panels such as illustrated and described in the former patent which are opposed to each other will be held by the tying apparatus and that these panels may be of any desired height or width. Although many different constructions may be utilized in the structure of the form panels 2, such as employing steel, aluminum, ply wood, etc., a suitable structure for a form panel 2 may comprise a ply wood panel 4 braced with horizontal wooden walers 6 and vertical steel channel walers 8.

Releasably attached to the vertical walers 8 are a plurality of the tie anchoring apparatus units 10 which serve to releasably clamp the form panels to ties 12 (FIG. 2) that extend through the concrete structure which may suitably be a vertical concrete wall that is being constructed, all as disclosed in Strickland et al U.S. Pat. No. 4,044,986.

Although the particular form of tie is not a part of the instant invention, a tie 12 may conveniently comprise either a solid steel member or, as illustrated on the drawing, a threadedly connected multi-part steel structure. In the embodiment illustrated, the tie 12 comprises an inner tie rod embedded in the concrete and having threaded ends, each of these ends threadedly receives an enlongated nut 18. The nut 18 in turn is threaded onto the outer end of the tie rod which extends outwardly through an opening formed in the anchoring apparatus, as will be described hereinafter. More detailed description of an appropriate tie and anchoring nut 18 may be found in Strickland et al U.S. Pat. No. 4,044,986. The clamping engagement of the ties 12 with the several anchoring apparatus units 10 secures the form panel 2 against substantial displacement longitudinally of the ties 12 which are used in assembling form panels in concrete construction as more fully described in the above mentioned Strickland et al patent.

Figure 2:
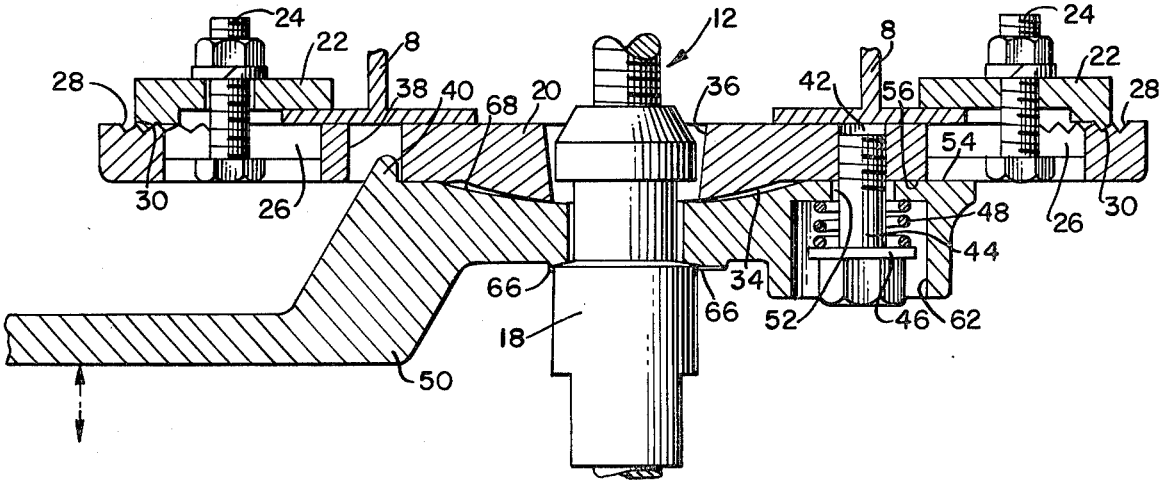
FIG. 2 is a sectional view taken on line 2—2 of FIG. 1.

Considering the anchoring apparatus unit 10 that forms the subject of the instant invention, such apparatus provides a load bearing member 20. This load bearing member has, at each end thereof, gripping members which are mounted on the rear face of the anchoring apparatus unit 10, to releasably connect the bearing member to the outside of the form panel such as by clamping onto the flanges of the I beams forming walers 8, as shown in FIGS. 1 and 2. These clamping members, as shown in FIGS. 1 and 2, are provided by ears 22. Each ear is urged into clamping rejationship with a flange of a waler 8 by a nut and bolt connector 24. The connector 24 for each ear 22 is disposed in an elongated slot 26, such that the ear 22 may be adjusted to accommodate varying spacing between the walers 8. To hold the ears 22 in place against lateral displacement, the rear face of bearing member 20 is provided with a series of spaced grooves 28 and the clamping member 22 has a tooth 30 which engages in one of these grooves 28 to hold the ear 22 in place once the nut and bolt connector 24 is tightened against the flange of waler 8. As shown in FIG. 1, each ear 22 has an extension 32 disposed at each end thereof which embraces the opposite sides of the end of bearing member 20 to retain the ear 22 in proper position for its clamping function. Also, in FIG. 1 it will be seen that slot 26 has an enlarged pocket on the outer surface of bearing member 20 which houses the head of bolt connector 24 to not only recess the head against exposure to damage or injury to workers but also serve to hold the bolt head against turning and thus ease the task of tightening the nut on connector 24 when fixing the anchoring apparatus on walers 8.

The bearing member 20 has a convexly curved surface 34 surrounding an opening 36 formed centrally of the length of the bearing member 20 to accommodate passage of an elongated tie portion, as shown in solid line in FIG. 2 and in phantom lines in FIG. 1.

The outer face of the bearing member 20 has a cavity 38 disposed to receive a detent 40 carried by the clamping member described hereinafter. A groove 40 leading toward cavity 38 acts to cam the clamping member away from the bearing member 20 as the clamping member is moved to closing position, as will be described hereinafter.

Bearing member 20 has a threaded recess 42 which receives a bolt 44 carrying a washer 46 held beneath the head of bolt 44 with a coil spring 48 surrounding the shank of bolt 44 disposed beneath washer 46 and the head of the bolt.

A clamping member 50 is pivotally mounted on the stud formed by the shank of bolt 44. The clamping member 50 and the bearing member 20 are effectively interconnected by a connection which permits the clamping member to not only swing relative to the plane of the bearing member 20 but also permits the clamping member 50 to pivot parallel to the plane of bearing member 20. This connection is provided by the stud or shank of bolt 44 which is threaded into the recess 42 in bearing member 20. To enable the desired axially and laterally yieldable pivot connection in the specific embodiment illustrated, the clamping member 50 is provided with a bore 52 which is larger in diameter than the diameter of the stud or shank of bolt 44. Thus, the clamping member 50 may pivot in the plane of bearing member 20 and also may swing relative to the plane of the bearing member 20 by reason of the yieldable connection formed by the biasing action of spring 48 located in the enlarged bore 52 in clamping member 20. It may be noted that the bolt 44 threaded into the bearing member 20 has its shaft and head along with washer 46 and coil spring 48 disposed in a cavity 62. Thus, the bolt, washer and spring are protected against inadvertent damage or injury to workers in use of the anchoring apparatus.

Figure 3:
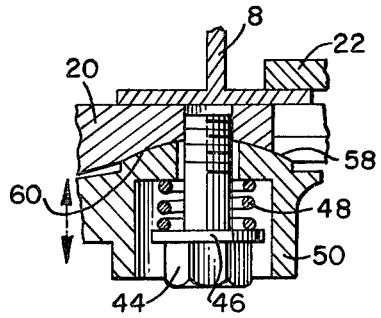
FIG. 3 is a sectional view showing a modification of the yieldable connection which may be employed in connecting the clamping member and bearing member of applicant's anchoring apparatus.

In the embodiment as illustrated in FIG. 2, the bearing member 20 and clamping member 50 have cooporating planar surfaces 56 and 54, respectively, on their opposed faces adjacent the yieldable pivot connection. In an alternative construction, which gives more or less of a ball and socket joint for pivoting of the clamping member 50 relative to the bearing member 20, as shown in FIG. 3, the opposed faces adjacent the yieldable pivot connection comprise a convex surface 58 on the clamping member 50 and a concave surface 60 on the bearing member 20.

Reference has previously been made to detent 40 carried by clamping member 50. In the pivoting movement of clamping member 50 relative to bearing member 20, the detent 40 enters the deeper portion of groove 40 at the side of bearing member 20 and due to the decreasing depth of such groove, the clamping member is cammed to swing away from bearing member 20. This swinging movement is provided by the connection interconnecting the bearing and clamping members which allows both axially and laterally yieldable movement between the two members. When the detent in the movement of clamping member 50 toward its closed position, as shown in FIG. 2, enters cavity 38, the action of biasing spring 48 causes the detent 40 to enter the cavity and thereby retain the bearing member and clamping member in closed position.

The clamping member 50 has a pocket 64 which opens outwardly of one side of the clamping member 50 so that upon pivoting movement of this clamping member relative to the opening 36 in the bearing member 20 the portion of the tie 12 namely, nut 18 which is extending outwardly through opening 36, is clampingly engaged within the pocket 64. Each edge of the entrance to pocket 64 which opens outwardly from one side of the clamping member 50 has a raised portion 66 adjacent the pocket entrance. This raised edge which may be provided on only one side of the pocket entrance but which is illustrated and preferred to be present on both sides of the pocket entrance assists in retaining the tie portion fully within the pocket 64 when the clamping member 50 is in closed position engaging the tie portion.

The engagement, cooperation and functioning of the clamping member 50 in releasably clamping by engaging the portion of the tie 12 and specifically the nut 18 thereon is more fully described and explaned in Strickland et al U.S. Pat. No. 4,044,986.

The underside of clamping member 50 is provided with a concave configuration 68. This provides a mating surface portion that mates with the convex surface portion 34 on the outer surface of bearing member 20. Such construction, with the two mating surface portions being curved as illustrated, enables the clamping member 50 to adjust relative to the bearing member 20 that is fixed to the concrete form panel 2 for any misalignment of the tie 12 and the form panel 2 or misalignment between opposing form panels 2.

To provide a stop in both directions of swinging movements of clamping member 50 relative to bearing member 20, the bearing member on its outer surface carries a stop projection 70. A shoulder portion 72 adjacent the entrance to pocket 64 on the clamping member 50 engages one end of projection 70 when the clamping member 50 is pressed toward a fully closed position such that the stop resists further force that might be applied when the detent 40 on clamping member 50 is disposed within the cavity 38 of the bearing member 20. A second radially extending shoulder 74 comparable to the shoulder provided by portion 72 on the clamping member 50 is provided, as shown in FIG. 1, so that in the fully opened position of clamping member 50, as shown in the relationship of the clamping member to the bearing member in FIG. 1, shoulder 74 engages the opposite edge of stop projection 70 to prevent undue or unnecessary pivoting of the clamping member 50 relative to the bearing member 20.

It may be mentioned that the raised edges 66 at the entrance to pocket 64 provide a safety feature in that when the anchoring apparatus 10 is in use, the tension on tie rod against the nut 18 of tie 12 pulls the nut and clamping member into firm engagement with the cooperating surface of the bearing member 20. In this position the tie 12 holds the clamping member 50 firmly against the bearing member 20 with the detent 40 securely retained within the cavity 38. Likewise, the raised edges 66 tend to hold the shoulder on the tie nut 18 within cavity 64 against possible displacement or accidental effort to pivot the clamping member 50 out of its closed position, as shown in FIG. 2.

In the embodiments illustrated and described, the connection between the bearing member 20 and clamping member 50 enables axially and laterally yieldable movement between the two members so that the clamping member may swing relative to the plane of the bearing member and also may pivot relative to the bearing member. Although the embodiments show an enlarged bore 52 relative to the diameter of stud or shaft of bolt 44 and a biasing spring 48, it is to be understood that other structures may be employed to enable the clamping member to swing relative to the plane of the bearing member and to pivot parallel to the bearing member. It should be obvious that these and numerous other variations and modifications of the apparatus of this invention will readily occur to those skilled in the art. Accordingly, the scope of this invention is not to be limited to the disclosed embodiments but is to include all such embodiments encompassed within the scope of the claims appended hereto.

I claim:

1. Anchoring apparatus for holding a concrete form panel to an elongated tie to restrain outward movement of the panel relative to the tie comprising:

a load bearing member fixedly connectible to the outside of the form panel and having an opening through which a tie is extendable, a clamping member releasably clampingly engageable with a portion of a tie which is extending outwardly through said opening, an axially and laterally yieldable pivot connection pivotally securing said clamping member to said load bearing member to permit said clamping member to swing relative to the plane of said bearing member and pivot relative to said bearing member, and said members having curved mating surface portions contoured to provide a ball and socket type joint between said members to permit compensative movement of said clamping member relative to said bearing member to accommodate misalignment between the tie and the form panel or misalignment between opposing form panels.

2. Anchoring apparatus as recited in claim 1 wherein said mating surface portions comprise a convexly curved area and a concavely curved area, one of said areas being on one of said members and the other of said areas being on the other of said members.

3. Anchoring apparatus as recited in claim 1 wherein said pivot connection comprises a stud mounted on said bearing member, a bore in said clamping member larger than the diameter of said stud and through which said stud extends, and spring means retained on said stud and biasing said clamping member toward said bearing member for said mating surface portions to be engaged.

4. Anchoring apparatus as recited in claim 3 wherein said stud is formed by a bolt threaded into said bearing member with the bolt head disposed in a cavity formed in said clamping member outwardly of said bore, and said spring means is a coil spring disposed in said cavity and retained beneath said bolt head.

5. Anchoring apparatus as recited in claim 1 wherein said bearing member has gripping members mounted at the rear of said bearing member to releasably connect that bearing member to the outside of the form panel.

6. Anchoring apparatus as recited in claim 1 wherein said clamping member has a pocket opening outwardly of one side of said clamping member so that upon pivoting movement of said clamping member relative to said opening in said bearing member the portion of the tie which is extending outwardly through the bearing member opening is clampingly engaged within said pocket, said pocket having at least one raised edge adjacent the pocket entrance opening outwardly from said one side of said clamping member, said raised edge assisting in retaining the tie portion fully within said pocket when said clamping member is in closed position engaging the tie portion.

7. Anchoring apparatus as recited in claim 6 wherein both of the sides of said pocket have a raised edge adjacent the pocket entrance.

8. Anchoring apparatus as recited in claim 1 wherein a stop projection is mounted on the outer side of said bearing member radially outwardly of said bearing member opening, and said clamping member having radially extending shoulders circumferentially spaced relative to the axis of said pivot connection, one of said shoulders being engageable with said stop projection when said clamping member is in its fully open position and the other of said shoulders being engageable with said stop projection when said clamping member is pressed toward a fully closed position.

9. Anchoring apparatus as recited in claim 1 wherein a detent is provided on the face of said clamping member opposed to the outer face of said bearing member, and said bearing member has a cavity opening through said outer bearing member face disposed to receive said clamping member detent when said clamping member is moved to closed position whereby said members are retained in closed position to clampingly engage the portion of the tie which is extending outwardly through said bearing member opening.

10. Anchoring apparatus as recited in claim 9 wherein said outer surface of said bearing member is provided with a groove leading toward said cavity, said groove being of decreasing depth as it nears said cavity so that said detent on said clamping member enters said groove and swings said clamping member about said yieldable pivot connection as said clamping member is moved toward closed position until said detent enters said cavity, said yieldable pivot connection permitting said clamping member to be raised to free said detent from said cavity to allow movement of said clamping member to open position.

11. Anchoring apparatus as recited in claim 1 wherein said bearing member and said clamping member have cooperating planar surfaces on their opposed faces adjacent said yieldable pivot connection.

12. Anchoring apparatus as recited in claim 1 wherein said bearing member and said clamping member have cooperating concave and convex surfaces on their opposed faces adjacent said yieldable pivot connection, said concave surface being on one of said members and said convex surface being on the other of said members.

13. Anchoring apparatus for holding a concrete form panel to an elongated tie to restrain outward movement of the panel relative to the tie comprising:

a load bearing member fixedly connectible to the outside of the form panel and having an opening through which a tie is extendable, a clamping member releasably clampingly engageable with a portion of a tie which is extending outwardly through said opening, a connection interconnecting said bearing member and said clamping member together, said connection being constructed to permit said clamping member to swing relative to the plane of said bearing member and to pivot parallel to the plane of said bearing member, said members having mating surface portions adjacent said bearing member opening.

14. Anchoring apparatus as recited in claim 13 wherein said connection provides for both axial and lateral movement between said clamping member and said bearing member.

15. Anchoring apparatus as recited in claim 14 wherein said members have curved mating surface portions contoured to provide a ball and socket type joint between said members to permit compensative movement of said clamping member relative to said bearing member to accommodate misalignment between the tie and the form panel or misalignment between opposing form panels.

* * * * *